United States Patent [19]

Perry

[11] 3,950,849

[45] Apr. 20, 1976

[54] RAZOR WITH ROTATABLY MOUNTED SHAVING UNIT

[75] Inventor: Roger L. Perry, Lynnfield Center, Mass.

[73] Assignee: The Gillette Company, Boston, Mass.

[22] Filed: July 23, 1974

[21] Appl. No.: 490,930

[52] U.S. Cl. ..... 30/47; 30/57

[51] Int. Cl.[2] ..... B26B 21/14

[58] Field of Search ..... 30/32, 38, 50, 47, 57, 30/87

[56] References Cited

UNITED STATES PATENTS

| | | | |
|---|---|---|---|
| 2,744,318 | 5/1956 | Borden | 30/87 X |
| 3,388,831 | 6/1968 | Hansom | 30/47 X |
| 3,593,416 | 7/1971 | Edson | 30/50 |
| 3,740,841 | 6/1973 | Risher | 30/57 X |
| 3,816,913 | 6/1974 | Ferraro | 30/47 |

*Primary Examiner*—Al Lawrence Smith
*Assistant Examiner*—Gary L. Smith
*Attorney, Agent, or Firm*—Richard A. Wise; Oistein J. Bratlie; Scott R. Foster

[57] ABSTRACT

A razor blade assembly includes a razor blade shaving unit comprising a substantially rigid member to which a razor blade is secured in a permanent manner with the rigid member having a forward edge providing a guard surface spaced from a cutting edge of the razor blade. The razor blade assembly further includes a connector member attached to the shaving unit in such a manner that the shaving unit is movable relative to the connector member. The connector member is provided with a plurality of surfaces forming channel means longitudinally thereof for receiving supporting surfaces of a holder.

12 Claims, 6 Drawing Figures

8
18
14
16
12
12
26
22
6
20
10
38
16
40
30
34
2
84
84
78
70
28
36
32
84
82
74
76
72
80
50
84
52
4
56
54
52

V
IV
22
24
20
20
6
2
28
30
16
16
16
16
4
52
40
38
36
32
76
72
74
78
34
70
V
62
IV 22
24
26
12
14
10
8
28
20
2
40
6
76
50
32
84
74
52
76
58
72
32
58
56
60
60
56
4
62

26
10
12
24
14
22
2
20
8
28
6
50
76
84
40
76
32
52
72
60
74
60
4
58
32
58
56
56
62

RAZOR WITH ROTATABLY MOUNTED SHAVING UNIT

BACKGROUND OF THE INVENTION

1. Field of the Invention

This invention relates to wet shaving systems and more particularly to a razor blade assembly of the type in which a razor blade is secured in a permanent manner in a substantially rigid member having a forward edge provided with a guard surface spaced from a cutting edge of the razor blade.

2. Description of the Prior Art

At the present time the majority of shavers employs a shaving implement that has a grip portion and carries one or more blade elements that extend generally transversely to the grip portion. Shaving implements of this type include a variety of configurations; for example, a system in which a single or double edge blade is inserted into a holder by the user; a system employing a cartridge which holds a length of band blade, the user advancing successive links of the band for shaving; and a system in which a blade unit has a blade element permanently secured to a guard structure. In such shaving implements, the blade element and cooperating leading and following skin engaging surfaces define a set of shaving geometry relationships.

Continuing efforts are being made to improve the shaving characteristics of such implements and/or to accommodate individual preferences. A factor in shaving efficiency and effectiveness is the orientation of the active components of the shaving system relative to the skin surface being shaved. That surface frequently has undulations or is in a relatively inaccessible or awkward area to reach and the shaving action is reduced in efficiency because the relationship of the active elements to the skin surface being shaved significantly departs from the optimum value.

It has been proposed to improve the shaving action by providing a shaving implement in which the active portions of the shaving system are movable relative to the grip portion of the implement and conformable or responsive to the surface of the skin being shaved.

SUMMARY OF THE INVENTION

Accordingly, it is an object of this invention to provide a novel and improved razor blade assembly which allows a dynamic mode of shaving action.

Another object of the invention is to provide a novel and improved razor blade assembly which incorporates this dynamic shaving action feature and which is relatively easy and economical to manufacture and is sturdy and reliable in use.

Still another object of the invention is to provide a balanced, sturdy, shaving system that provides increased shaving efficiency and effectiveness.

With the above and other objects in view, as will hereinafter appear, there is provided a razor blade assembly including a razor blade shaving unit movably attached to a connector member. The razor blade shaving unit comprises a substantially rigid member to which a razor blade is secured in a permanent manner with the rigid member having a forward edge providing surface guard suface spaced from a cutting edge of the razor blade. The connector member is provided with a plurality of surfaces forming channel means longitudinally thereof so that the connecting member may receive supporting surfaces of a holder, or razor handle.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principals and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
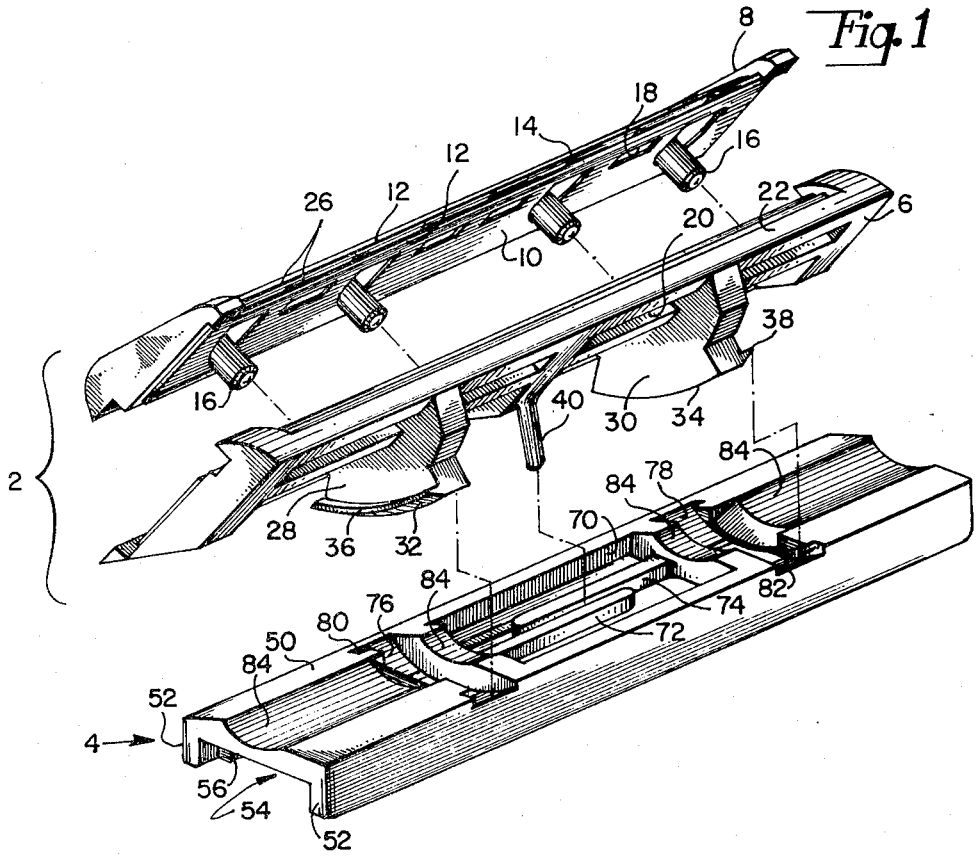
FIG. 1 is a perspective exploded view of one form of razor blade assembly illustrative of an embodiment of the invention.

Referring to FIG. 1, it will be seen that the illustrative razor blade assembly includes a razor blade shaving unit 2 and a connector member 4.

The shaving unit 2 includes a substantially rigid member 6, serving as a platform member, a cap member 8, and a blade means 10 comprising one or more blade members 12. Where the blade means 10 comprises more than one blade member 12, there may be included in the shaving unit 2 spacer means 14 (FIGS. 4–6) sandwiched between two blade members 12, which in turn are sandwiched between the platform member 6 and the cap member 8. One or the other of the cap and platform members has integral therewith a plurality of posts 16 (FIG. 1), which in assembly of the shaving unit, are extended through openings in other portions of the shaving unit and expanded rivet-like (FIG. 2) to secure the various parts together. The blade means 10 (FIG. 1) and platform member 6 are provided with passages 18, 20, respectively, through which shaving debris may flow. The platform member 6 has a forward edge 22 providing a guard surface 24 spaced from one or more cutting edges 26 of the blade means 10.

The platform member 6 is further provided with a pair of protrusions or rocker portions 28, 30 extending from the underside thereof. Each rocker portion has a curved surface 32, 34 on its extremity furthest from the platform member 6. The rocker portions 28, 30 are provided with curved outwardly extending flanges 36, 38 adjacent the curved surfaces 32, 34. The flanges extend, respectively, toward the nearest platform end, thereby extending in opposite directions. Also depending from the underside of the platform member 6 is a post 40.

The connector member 4 includes a top portion 50 and two depending side portions 52 forming a channel means 54. Extending into the channel means 54 from either side portion 52 are two opposed ribs 56, shown more clearly in FIGS. 3–6, which define opposed grooves 58 adapted to receive runner means 60 of a support or handle 62.

The connector member top portion 50 is provided with a central opening 70 into which extend, in a direction parallel to the longitudinal axis of the connector member, a pair of elongated fingers 72, 74, the fingers extending from opposite ends of the opening 70 and being offset from each other. The connector member 4 also has two arcuate slots 76, 78, the slots being provided with grooves 80, 82, such that each slot and groove is shaped complementarily to a corresponding rocker portion and flange for receiving the rocker and flange therein. The top portion 50 of the connector member 4 is further provided with an arcuate face 84 interrupted by said slots 76, 78 and said opening 70.

Figure 2:
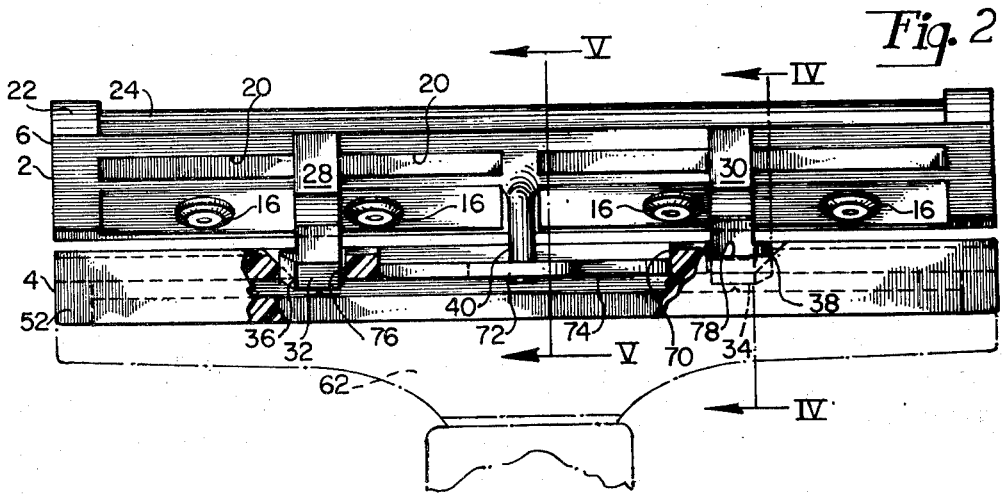
FIG. 2 is a front elevational view of the razor blade assembly shown in FIG. 1 with portions broken away for clarity.
Figure 3:
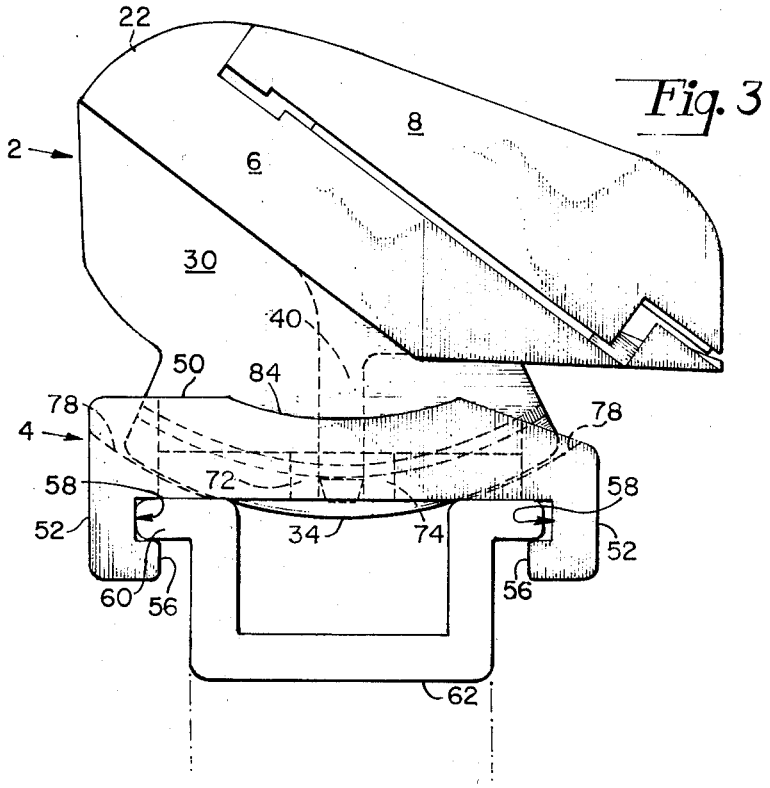
FIG. 3 is a side elevational view of the razor blade assembly shown in FIGS. 1 and 2.
Figure 4:
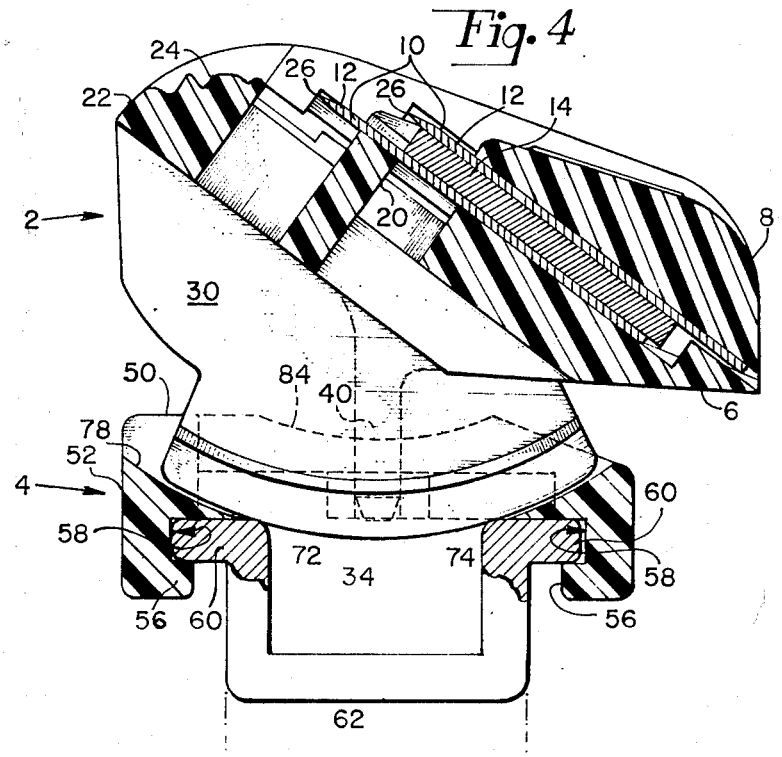
FIG. 4 is a sectional view taken along line IV—IV of FIG. 2.

Referring to FIGS. 2–4 it will be seen that the shaving unit 2 is joined to the connector member 4 by the interfitting of the rocker portions 28, 30 of the shaving unit 2 and the slots 76, 78 of the connector member 4, the rocker portions being retained in the slots by the flanges 36, 38 in the arcuate grooves 80, 82. The post 40 extends between the fingers 72, 74 and abuts the fingers which operate as leaf spring biasing structure, urging the post 40 to remain in a "neutral" position (FIGS. 3 and 4).

Figure 5:
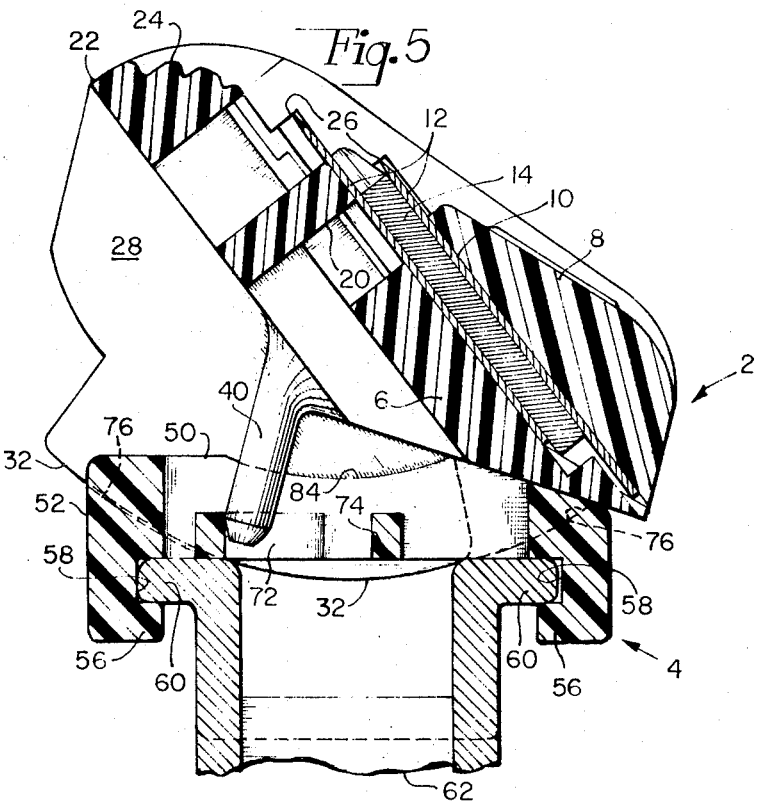
FIG. 5 is a sectional view taken along line V—V of FIG. 2, but showing the shaving unit at an extreme position in its permitted movement.
Figure 6:
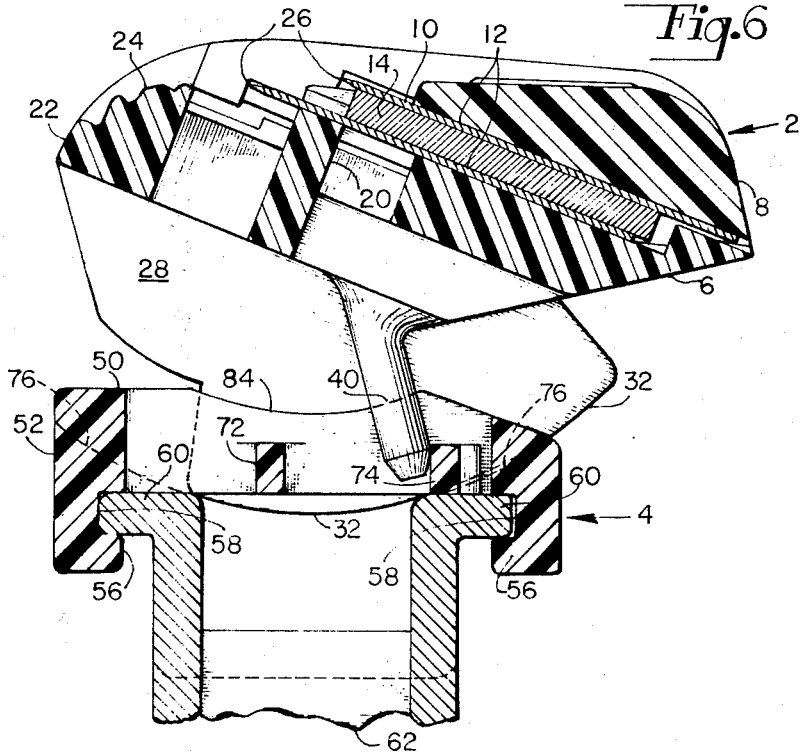
FIG. 6 is a sectional view, similar to FIG. 5, but showing the shaving unit in an opposite extreme position in its permitted movement.

In FIG. 5, there is shown the shaving unit 2 tilted upwardly or backwardly (clockwise as viewed in FIG. 5), the post 40 having disengaged from the finger 74 and exerted pressure against the finger 72, which, as it is displaced, biases the post 40 toward its neutral position. In FIG. 6, there is shown the shaving unit 2 tilted downwardly or forwardly (counterclockwise as viewed in FIG. 6), the post 40 having disengaged from the finger 72 and exerted pressure against the finger 74 which acts as a leaf spring, exerting a restoring force upon the post 40, and therefore the shaving unit 2, urging the post and shaving unit back to the neutral position where the restoring force of the two fingers, or leaf springs 72, 74, is balanced.

In operation, a razor blade assembly, or cartridge comprising the shaving unit and connector member fixed together, is brought into sliding engagement with the runner means 60 of an appropriate handle 62. A detent and notch arrangement, not shown but known in the art, may be used to positively locate the cartridge on the handle. The cartridge and handle may then be used as would any "wet" razor. During the shaving operation, the shaving unit 2 is movable relative to the connector member 4 and handle 62, conformable and/or responsive to the surface of the skin being shaved, but always biased toward its neutral orientation.

Having thus described my invention what I claim as new and desire to secure by Letters Patent of the United States is:

1. A razor blade assembly comprising a razor blade shaving unit, said shaving unit comprising a substantially rigid member to which a razor blade is secured in a permanent manner with said rigid member having a forward edge providing a guard surface spaced from a cutting edge of said razor blade, and a connector member distinct from and interfitted with said shaving unit such that said shaving unit is movable relative to said connector member, said connector member having a plurality of surfaces forming a channel therein for receiving supporting surfaces of a holder, said connector member being attached to said shaving unit such that when said connector member is engaged with said holder said connector member is the sole support for said shaving unit and is disposed between said shaving unit and said holder and separates said shaving unit from said holder.

2. The razor blade assembly as claimed in claim 1 wherein said connector member is attached to said shaving unit such that said shaving unit is rotatable relative to said connector member about an axis extending longitudinally of said connector member and parallel to said channel.

3. The razor blade assembly as claimed in claim 1 and further including restoring structure arranged to generate a force when said razor blade shaving unit is offset from a position of neutral orientation relative to said connector member tending to move said razor blade shaving unit towards said position of neutral orientation.

4. The razor blade assembly as claimed in claim 1 and further including biasing structure tending to maintain said razor blade shaving unit in preferred orientation relative to said connector member.

5. The razor blade assembly as claimed in claim 4 wherein said biasing structure includes a post and leaf spring arrangement extending between said razor blade shaving unit and said connector member.

6. The razor blade assembly as claimed in claim 4 wherein said biasing structure includes two leaf spring members for providing two opposed restoring forces tending to maintain said razor blade shaving unit in said preferred orientation where said restoring forces are balanced.

7. The razor blade assembly as claimed in claim 1 and further including restoring structure arranged to generate a force when said razor blade shaving unit is offset from a position of neutral orientation relative to said connector member tending to move said razor blade shaving unit toward said position of neutral orientation.

8. The razor blade assembly as claimed in claim 1 wherein said connector member has openings therein and said razor blade shaving unit has protrusions extending therefrom and through said connector member openings.

9. The razor blade assembly as claimed in claim 1 and further including restoring structure arranged to generate a force when said razor blade shaving unit is offset from a position of neutral orientation relative to said connector member tending to move said razor blade shaving unit toward said position of neutral orientation, said restoring structure including an elongated member extending between said razor blade shaving unit and said connector member and engageable with two leaf spring members for providing two opposed restoring forces tending to maintain said razor blade shaving unit in said neutral orientation where said restoring forces are balanced.

10. A razor blade assembly comprising a razor blade shaving unit, said shaving unit comprising a substantially rigid member to which a razor blade is secured in a permanent manner with said rigid member having a forward edge providing a guard surface spaced from a cutting edge of said razor blade, and a connector member attached to said shaving unit such that said shaving unit is movable relative to said connector member, and biasing structure tending to maintain said razor blade shaving unit in preferred orientation relative to said connector member, said biasing structure including a post and leaf spring arrangement extending between said razor blade shaving unit and said connector member, said connector member having a plurality of surfaces forming a channel therein for receiving supporting surfaces of a holder.

11. A razor blade assembly comprising a razor blade shaving unit, said shaving unit comprising a substantially rigid member to which a razor blade is secured in a permanent manner with said rigid member having a forward edge providing a guard surface spaced from a cutting edge of said razor blade, and a connector member attached to said shaving unit such that said shaving unit is movable relative to said connector member, and biasing structure tending to maintain said razor blade shaving unit in preferred orientation relative to said connector member, said biasing structure including two leaf spring members for providing two opposed restoring forces tending to maintain said razor blade shaving unit in said preferred orientation where said restoring forces are balanced, said connector member having a plurality of surfaces forming a channel therein for receiving supporting surfaces of a holder.

12. A razor blade assembly comprising a razor blade shaving unit, said shaving unit comprising a substantially rigid member to which a razor blade is secured in a permanent manner with said rigid member having a forward edge providing a guard surface spaced from a cutting edge of said razor blade, and a connector member attached to said shaving unit such that said shaving unit is movable relative to said connector member, and restoring structure arranged to generate a force when said razor blade shaving unit is offset from a position of neutral orientation relative to said connector member tending to move said razor blade shaving unit toward said position of neutral orientation, said restoring structure including an elongated member extending between said razor blade shaving unit and said connector member and engageable with two leaf spring members for providing two opposed restoring forces tending to maintain said razor blade shaving unit in said neutral orientation where said restoring forces are balanced, said connector member having a plurality of surfaces forming a channel therein for receiving supporting surfaces of a holder.

* * * * *